US007671855B2

(12) United States Patent
Lee et al.

(10) Patent No.: US 7,671,855 B2
(45) Date of Patent: Mar. 2, 2010

(54) LCD, AND DRIVING DEVICE AND METHOD THEREOF

(75) Inventors: Seung-Woo Lee, Seoul (KR); Man-Bok Cheon, Yongin (KR); Su-Hyun Kwon, Yongin (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 863 days.

(21) Appl. No.: 11/416,334

(22) Filed: May 1, 2006

(65) Prior Publication Data

US 2006/0197731 A1 Sep. 7, 2006

Related U.S. Application Data

(62) Division of application No. 10/075,285, filed on Feb. 15, 2002, now Pat. No. 7,038,673.

(30) Foreign Application Priority Data

Feb. 15, 2001 (KR) ..... 2001-007453

(51) Int. Cl.
*G09G 5/00* (2006.01)

(52) U.S. Cl. ..... 345/211; 345/92; 345/94; 345/208

(58) Field of Classification Search ..... 345/211, 345/92, 94–97, 208–210
See application file for complete search history.

(56) References Cited

U.S. PATENT DOCUMENTS

| | | | |
|---|---|---|---|
| 5,648,793 | A | 7/1997 | Chen |
| 5,828,368 | A | 10/1998 | Jung |
| 6,421,038 | B1 | 7/2002 | Lee |
| 6,693,618 | B2 | 2/2004 | Son et al. |
| 6,744,417 | B2 | 6/2004 | Yamashita et al. |
| 2002/0075212 | A1 | 6/2002 | Song |
| 2002/0163488 | A1 | 11/2002 | Song et al. |
| 2003/0227433 | A1 | 12/2003 | Moon |
| 2004/0196232 | A1 | 10/2004 | Kim et al. |
| 2005/0253832 | A1 | 11/2005 | Chung |

FOREIGN PATENT DOCUMENTS

| | | | |
|---|---|---|---|
| EP | 0562728 | A2 | 9/1993 |
| GB | 2071372 | A | 9/1981 |

OTHER PUBLICATIONS

European Search Report corresponding to EP 02002092.1-1228, Sep. 23, 2009, 3 pages.

*Primary Examiner*—Richard Hjerpe
*Assistant Examiner*—Leonid Shapiro
(74) *Attorney, Agent, or Firm*—Innovation Counsel LLP

(57) ABSTRACT

Disclosed are an LCD capable of realizing a pre-charging method even in the random data-enable mode, and an apparatus and method for driving the same. In the LCD driving apparatus, a timing controller outputs a vertical sync start signal based on a data-enable signal having an irregular output interval to control the output of the image data. A gate driver sequentially applies both first and second gate-on voltages to a same gate line based on the vertical sync start signal. The first gate-on voltage is to drive a previous line being most adjacent to and having the same polarity as the current line, and the second gate-on voltage is to drive the current line. An LCD panel is first charged with the first gate-on voltage supplied from the gate driver, and then charged with the second gate-on voltage, so that it can display analog image data received from the data driver during the second charging.

10 Claims, 5 Drawing Sheets

LCD, AND DRIVING DEVICE AND METHOD THEREOF

CROSS-REFERENCE TO RELATED APPLICATIONS

This application is a divisional of U.S. patent application Ser. No. 10/075,285, filed Feb. 15, 2002, now U.S. Pat. No. 7,038,673, by Seung-Woo Lee, Man-Bok Cheon, and Su-Hyun Kwon, entitled "LCD, AND DRIVING DEVICE AND METHOD THEREOF;" which claims priority of Korean Patent Application No. 2001-007453 filed Feb. 15, 2001.

BACKGROUND OF THE INVENTION (a) Field of the Invention

The present invention relates to a liquid crystal display and an apparatus and method for driving the same. More specifically, the present invention relates to a liquid crystal display capable of realizing a pre-charging method even in the random data-enable mode, and an apparatus and method for driving the same.

(b) Description of the Related Art

In general, a liquid crystal display (LCD) is a display device in which an electric field is applied to a liquid crystal layer having anisotropic dielectric constant permitivity sandwiched between two substrates, said electric field being adjusted to control the amount of light incident upon the substrates and thereby obtain a desired image. Such LCDs, including inter alia, a flat panel type display (FPD) that is very handy to carry, and a thin film transistor (TFT) LCD using a TFT as a switching element are, widely used.

Increased resolution of the LCD has lead to a rapid reduction of the pixel charging time needed. A pre-charging method as illustrated in FIG. 1 is used in order to compensate for the reduced charging time. The term "pre-charging method" as used herein refers to a method of charging a specific pixel over time that involves previously charging a corresponding pixel with data of an adjacent pixel (i.e. a pixel adjacent to the conrresponding pixel) having the same polarity as the corresponding pixel so as to invert the polarity of the pixel and thereafter charging the adjacent pixel with the data of the corresponding pixel.

A conventional gate signal usually appears every frame. However, as illustrated in FIG. 1, the typical pre-charging method compensates for the charging time in such a manner that an additional pre-charging gate pulse is used to previously charge the N-th pixel with the data of the (N−1)-th pixel having the same polarity as the N-th pixel prior to charging with the data of the N-th pixel.

More specifically, two vertical sync start signals STV have to be fed into the gate driver in order to generate a pre-charging gate pulse. For this purpose, use is made of a method of previously generating the vertical sync start signals STV at a designated position using a counter for a frame blank interval.

The data-enable (DE) mode makes the data-enable (DE) signal 'high' only during the interval having effective data. Driving the LCD without any problem, even with an irregular interval of the effective data, would be wanted. However, the conventional method using the counter is problematic in that it does not display an image when the interval of the effective data is irregular.

When the output interval of the effective data is irregular, i.e., in the random DE mode, the blank intervals of data-enable signals (for example, t1 and t2) are not conformable with each other, the consequence of which is failure to obtain a normal display of the LCD image.

SUMMARY OF THE INVENTION

It is an object of the present invention to solve the above problem regarding non-conformability and to provide an LCD capable of displaying all data even though a data-enable signal is randomly input.

It is another object of the present invention to provide an apparatus for driving the LCD.

It is further another object of the present invention to provide a method for driving the LCD.

In one aspect of the present invention, to achieve the first object, there is provided an LCD including: a timing controller for receiving external image data, and outputting a vertical sync start signal based on a data-enable signal having an irregular output interval to control the output of the image data, the vertical sync start signal having a generation interval associated with a blank interval of the data-enable signal; a data driver for converting the image data; a gate driver for sequentially applying both first and second gate-on voltages to a same gate line, wherein the first gate-on voltage is to drive a previous line being most adjacent to and having the same polarity as a present line, and the second gate-on voltage is to drive the present line; and an LCD panel being first charged with the first gate-on voltage supplied from the gate driver, and secondly charged with the second gate-on voltage, wherein the LCD panel displays the image data received from the data driver during the second charging.

In another aspect of the present invention, to achieve the second object, there is provided an apparatus for driving an LCD that includes an LCD panel having a plurality of data and gate lines, which charges a specific pixel by first charging the data of an pixel adjacent to the specific pixel and having the same polarity as the specific pixel to change the polarity of the corresponding pixel, and second by charging the data of the specific pixel, the LCD including: a timing controller for receiving external image data, and outputting a vertical sync start signal based on a data-enable signal having an irregular output interval to control the output of the image data, the vertical sync start signal having a generation interval associated with a blank interval of the data-enable signal; a data driver for converting the image data and outputting the converted image data to the data line of the LCD panel; and a gate driver for applying a first gate-on voltage to the gate line of the LCD panel to perform a first charging, and a second gate-on voltage to the gate line to perform a second charging, based on the vertical sync start signal, and controlling display of the converted image data supplied from the data driver during the second charging, wherein the first gate-on voltage is to drive a previous line being most adjacent to and having the same polarity as the present line, and the second gate-on voltage is to drive the present line.

In still another aspect of the present invention to achieve the above and other objects, the timing controller preferably includes: an internal data-enable converter for receiving the data-enable signal having an irregular output interval, and outputting an internal data-enable signal shifted by a predetermined number of lines; a counter for counting the data-enable signals applied to the internal data-enable converter to output first and second switching signals; a control signal generator for receiving the internal data-enable signal shifted by the predetermined number of lines to output a control signal for driving the LCD panel; a first switch having one input path and a plurality of output paths, for determining an output path of the image data signal based on the first switching signal; a memory section having a plurality of memories for respectively storing image data received via the first switch, and outputting the stored image data as the image data of the next line is applied to the timing controller; and a second switch having a plurality of input paths and one output path, for determining the input path of the image data received from the memory section based on the second switching signal, and outputting the image data to the data driver.

In still another aspect of the present invention, to achieve the third object, there is provided a method for driving an LCD that includes an LCD panel having a plurality of data and gate lines, which charges a specific pixel by first charging the data of an pixel adjacent to the specific pixel and having the same polarity as the specific pixel to change the polarity of the corresponding pixel, and second charging the data of the specific pixel, the method including: (a) receiving image data from an external image signal source and a data-enable signal for controlling output of the image data; (b) checking whether the data-enable signal has been received, sequentially recording the image data on a predetermined number of built-in memories upon receiving the data-enable signal, sequentially extracting the recorded image data, and generating an internal data-enable signal upon extraction of the image data to output a vertical sync start signal having a generation interval associated with a blank interval of the data-enable signal; (c) applying a voltage corresponding to the image data to the data lines; and (d) sequentially applying both first and second gate-on voltages based on the vertical sync start signal, wherein the first gate-on voltage is to drive a previous line being most adjacent to and having the same polarity as the present line, and the second gate-on voltage is to drive the present line.

Preferably, the data extraction based on the output of the vertical sync start signal in step (b) includes: (b-11) initializing a line count value and an internal flag; (b-12) checking whether the data-enable signal is present; (b-13) increasing the line count value by one and checking whether the updated line count value is greater than a first number of lines, which is the number of gate lines plus one, when the data-enable signal exists in step (b-12); (b-14) returning to step (b-12) when the updated line count value is equal to or less than the first number of lines, and generating a memory extraction flag signal to extract the data when the updated line count value is greater than the first number of lines; (b-15) checking whether the updated line count value is equal to the number of gate lines, and if not, returning to step (b-12); (b-16) generating an internal flag signal and increasing an internal flag count value by one, when the updated line count value is equal to the number of gate lines in step (b-15) or when the data-enable signal does not exist in step (b-12); and (b-17) comparing the updated interval flag count value with the first number of lines, ending the flow of the method when the internal flag count value is greater than the first number of lines, and returning to step (b-16) when the internal flag count value is equal to or less than the first number of lines.

Preferably, the data recording based on the output of the vertical sync start signal in step (b) includes: (b-21) initializing a line count value; (b-22) checking whether the data-enable signal is present, ending the flow of the method when the data-enable signal does not exist, and increasing the line count value by one when the data-enable signal exists; (b-23) generating a memory recording flag signal to record the data; and (b-24) checking whether the updated line count value in step (b-22) is equal to the number of vertically arranged gate lines, ending the flow of the method when the updated line count value is equal to the number of gate lines, and returning to step (b-22) when the updated line count value is not equal to the number of gate lines.

The LCD and the apparatus and method for driving the LCD use a built-in counter based on input data-enable signals to output an LCD control signal to a proper position in spite of the irregular positions of the input data-enable signals, which allows a normal display of all data in the presence of random inputs of the data-enable signals.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

In the following detailed description, only the preferred embodiment of the invention has been shown and described, simply by way of illustration of the best mode contemplated by the inventor(s) of carrying out the invention. As will be realized, the invention is capable of modification in various respects, all without departing from the invention. Accordingly, the drawings and description are to be regarded as illustrative in nature, and not restrictive.

Figure 1:
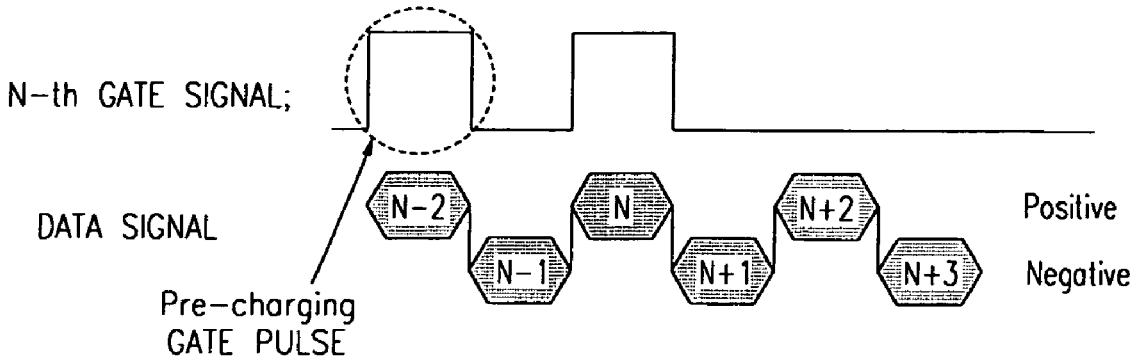
FIG. 1 is a waveform diagram illustrating a pre-charging gate pulse.
Figure 2:
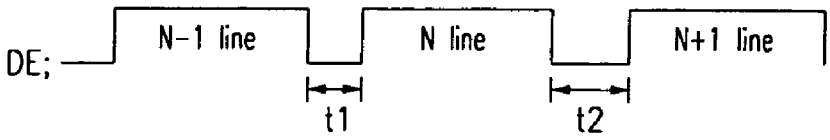
FIG. 2 is a waveform diagram illustrating the blank interval of a data-enable signal in the random DE mode.
Figure 3:
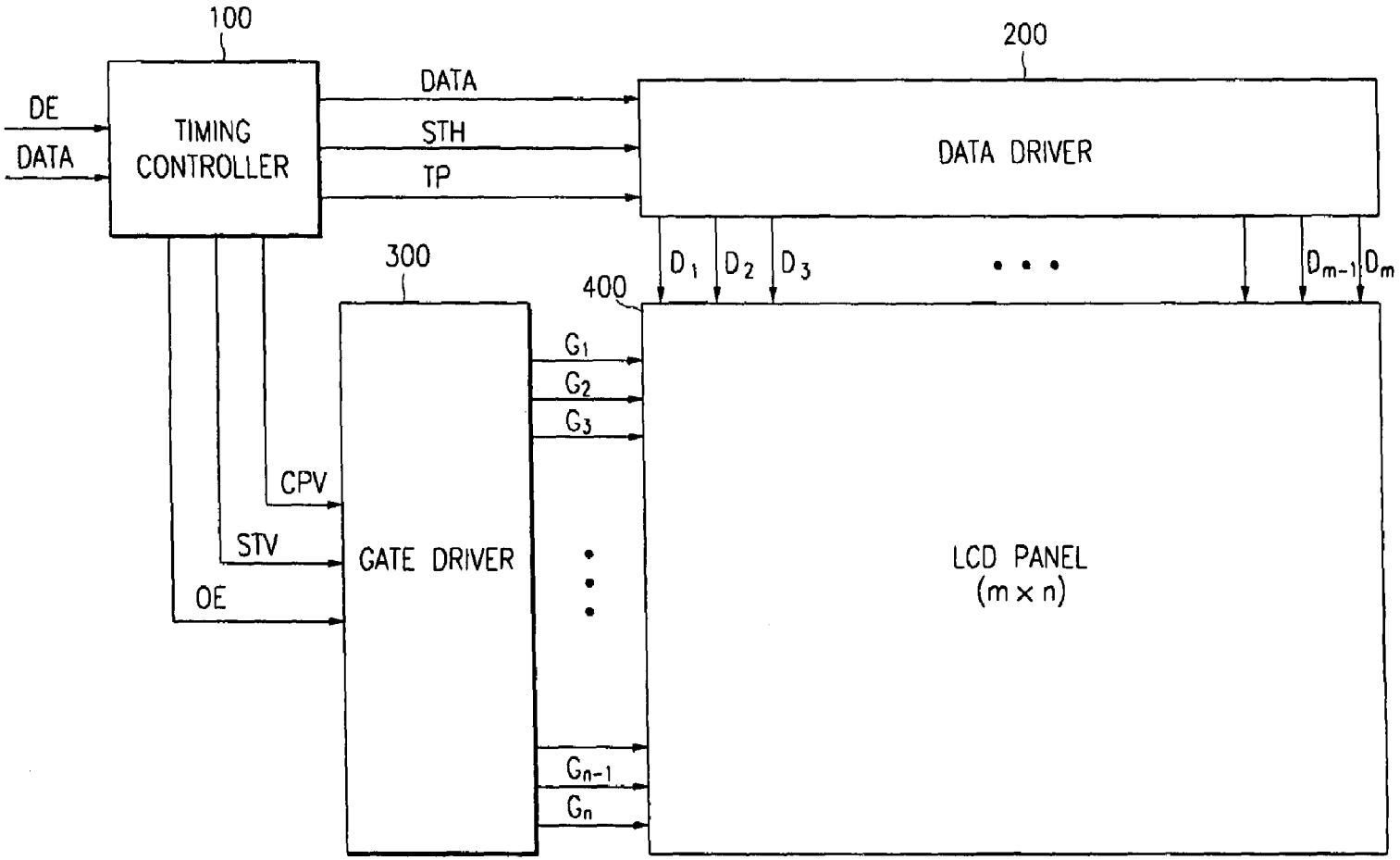
FIG. 3 is a diagram illustrating an LCD using the pre-charging method in accordance with an embodiment of the present invention.

FIG. 3 is a diagram illustrating an LCD using a pre-charging method in accordance with an embodiment of the present invention.

Referring to FIG. 3, an LCD using a pre-charging method in accordance with an embodiment of the present invention, comprises a timing controller 100, a data driver 200, a gate driver 300, and an LCD panel 400.

The timing controller 100 receives an RGB data signal DATA and a data-enable signal DE from an external graphic controller (not shown) and outputs to the data driver 200 the corresponding RGB data signal data, a horizontal start signal STH for RGB data transmission, and a TP (or LOAD) signal for starting the output to a data driver IC after the completion of the RGB data transmission.

The timing controller 100, receiving the RGB data signal DATA and the data-enable signal DE from the external graphic controller (not shown), also outputs to the gate driver 300 a gate clock signal CPV for selection of the next gate line, a vertical sync start signal STV for selection of the first gate line, and an output enable signal OE for controlling the output of the gate drive IC.

In particular, the vertical sync start signal STV output from the timing controller 100 according to the present invention includes not only a gate pulse for substantially driving the gate lines but also a gate pulse for pixel data applied to a most adjacent gate line (e.g., the (N−2)'th gate line) having the same polarity as the present gate line (e.g., the N'th gate line), namely, a pre-charging gate pulse.

The data driver 200 comprises a plurality of data driver IC's to generate a plurality of data signals STH and TP for the LCD panel 400 based on a plurality of control signals received from the timing controller 100. The data driver 200, for example, latches the individual RGB data sequentially received in accord with the applied TP signal to change a dot-at-a-time scanning timing system to a line-at-a-time scanning system, and outputs a plurality of data signals $D_1$, $D_2, \ldots, D_{m-1}$ and $D_m$ to the data lines of the LCD panel 400.

The gate driver 300 comprises a plurality of gate driver IC's and sequentially applies a gate-on signal to gate lines based on the control signals CPV, STV and OE received from the timing controller 100, turning on the TFT.

In particular, because the vertical sync start signal STV output from the timing controller 100 according to the present invention includes a control signal to apply a gate pulse for pixel data to a most adjacent gate line having the same polarity as the present gate line, as well as a control signal to apply a gate pulse to the present gate line, the gate-on voltage output from the gate driver 300 includes two gate lines for every frame to perform a previous charging with a gate pulse of the most adjacent previous line and thereafter substantially drive the gate lines of the LCD panel with the gate pulse of the present line.

The most adjacent line may be the first, the second, or the third previous line, or the like, that has the same polarity as the present line.

The LCD panel 400 has a plurality of gate lines for transmission of a gate-on signal supplied from the gate driver 300, and a plurality of data lines for transmission of a data voltage from the data driver 200. The regions surrounded with the gate and data lines form the respective pixels, each of which includes a thin film transistor (TFT) (not shown) with gate and source electrodes connected to the gate and data lines, respectively, and pixel and storage capacitors (not shown) connected to the drain electrode of the TFT, thus displaying specific image information.

In particular, according to the present invention, the gate-on signal applied from the gate driver 300 has two gate pulses every frame to previously perform charging with the gate pulse of the most adjacent line having the same polarity as the data applied to the present gate line for driving the present frame and for displaying RGB image data applied from the data driver 200 for driving the present line.

Figure 4:
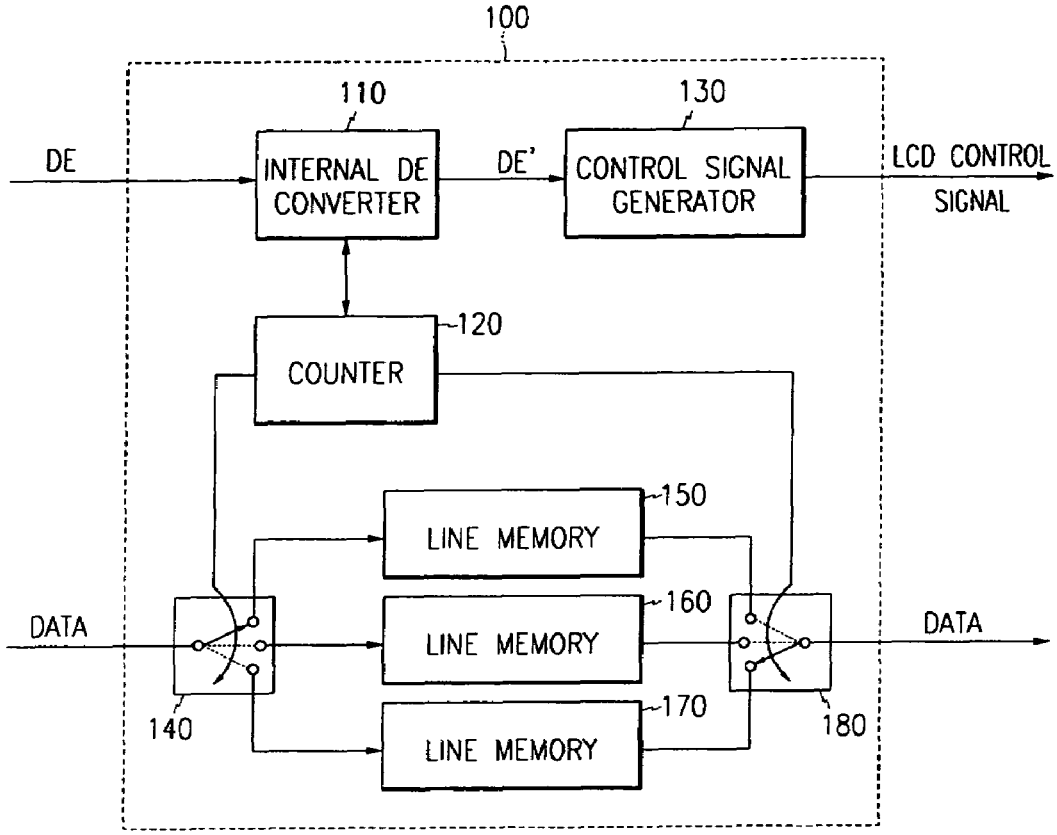
FIG. 4 is a detailed diagram of the timing controller shown in FIG. 3.
Figure 5:
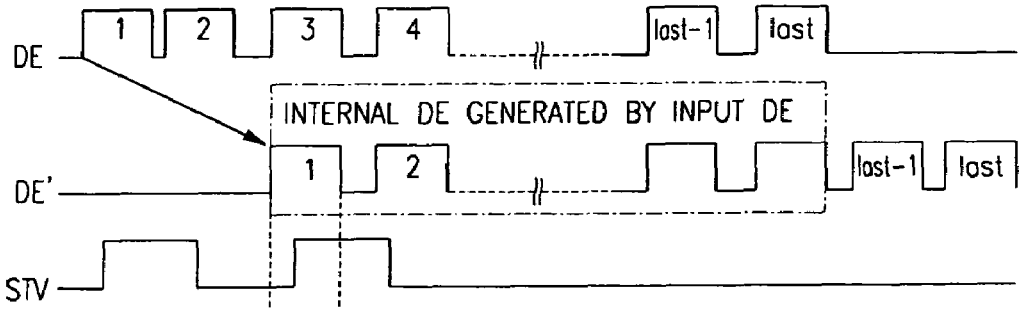
FIG. 5 is a waveform diagram illustrating a vertical sync start signal for pre-charging in the random DE mode in accordance with an embodiment of the present invention.

FIG. 4 is a detailed diagram of the timing controller shown in FIG. 3, and FIG. 5 is a waveform diagram illustrating a vertical sync start signal for pre-charging in the random DE mode in accordance with an embodiment of the present invention.

Referring to FIG. 4, the timing controller 100 according to the embodiment of the present invention includes an internal DE converter 110, a counter 120, a control signal generator 130, a first switch 140, a first memory 150, a second memory 160, a third memory 170, and a second switch 180.

The internal DE converter 110 receives a data-enable signal DE supplied from the graphic controller (not shown), more specifically a random DE signal, and outputs a two-line shifted internal data-enable signal DE' to the control signal generator 130. The output of the internal data-enable signal DE' is associated with the counting operation of the counter 120. The internal data-enable signal DE' is output in synchronization with the rising of the input DE from the third line of the random DE signal.

The counter 120 checks the input of the random DE signal applied to the internal DE converter 110, and when applying every frame, outputs a first switching signal to the internal DE converter 110 and the first switch 140 and a second switching signal associated with the first switching signal to the second switch 180.

The counter 120 further outputs the first switching signal to the internal DE converter 110 to control the output of the internal data-enable signal, and automatically generates the internal data-enable signal corresponding to the last two lines to compensate for the internal data-enable signal of the two missing lines.

The blank interval of the internal data-enable signal thus generated automatically may be the interval of a specific internal data-enable signal (for example, the internal data-enable signal copied in correspondence to the just previous line) or an interval that is usually defined.

The control signal generator 130 receives the two-line shifted internal enable signal DE' from the internal DE generator 110 and outputs control signals STH, TP, CPV, STV and OE for driving the LCD panel 400, to the data driver 200 and the gate driver 300.

In particular, the vertical sync start signal STV for realizing the pre-charging method according to an embodiment of the present invention applies a control signal to the gate driver 300 to output the gate pulse for the pixel data corresponding to the line prior to two lines from the current line as well as a control signal to output the gate pulse to the present line.

The first switch 140 comprises one port input terminal and three port output terminals and sequentially outputs the RGB image data signals applied from the graphic controller (not shown) to the first, second and third memories 150, 160 and 170 via any one of the three port output terminals in response to the first switching signal from the counter 120.

The first, second and third memories 150, 160 and 170 sequentially store the RGB image data received via the first switch 140 and output the stored RGB image data to the second switch 180 when the RGB image data of the next line are applied.

More specifically, in the case where the first, second and third memories 150, 160 and 170 comprise dual port memories that simultaneously perform read and write operations, the first, second and third image data are stored in the first, second and third memories 150, 160 and 170, respectively, and the first image data are output from the first memory 150 when the fourth image data are stored in the first memory 150.

On the other hand, in the case where the first, second and third memories 150, 160 and 170 comprise signal port memories that differently perform read and write operations, the first and third image data are stored in the first and second memories 150 and 160, respectively, and the first image data are output from the first memory 150 when the third image data are stored in the third memory 170.

The memory as used herein is a line memory capable of simultaneously applying RGB image data stored in every gate line.

The second switch 180 comprises three port input terminals and one port output terminal and sequentially outputs the RGB image data signals applied from the first, second and third memories 150, 160 and 170 to the data driver 200 in response to the second switching signal from the counter 120.

Now, a description will be given as to the generation algorithm of the vertical sync start signal STV for realizing the pre-charging method in the random DE mode according to the present invention as described above.

First, the three line memories 150, 160 and 170 are sequentially used to store RGB image data such that RGB image data for two lines (i.e., k-th and (k+1)-th lines) are stored in the first and second memories 150 and 160, respectively.

Sequentially, the data stored in the first memory 150 two lines prior are output to the data driver 200 while storing the RGB image data for the third line (i.e., (k+2)-th line) in the third line memory 170.

The internal DE signal DE' is generated in synchronization with the rising of the input DE signal from the third line of the input DE signal, because all LCD control signals STH, HCLK, OE and CPV are generated based on the DE signal and the internal DE signal DE' has to be generated after the two lines.

It is, however, impossible to generate the internal DE signals corresponding to the last two lines if the internal data-enable signal DE' is generated in such a way. To solve this problem, the counter 120 is used to determine which internal DE is generated for the present input data and to automatically generate an internal data-enable signal DE' corresponding to the last two lines. The blank width of the internal data-enable signal DE' is that of the normal data-enable signal.

Now, descriptions will be given as to a method for extracting data from a line memory and a method for recording data on the line memory based on the above-mentioned vertical sync start signal generating algorithm for realizing the pre-charging method in the random DE mode.

Figure 6:
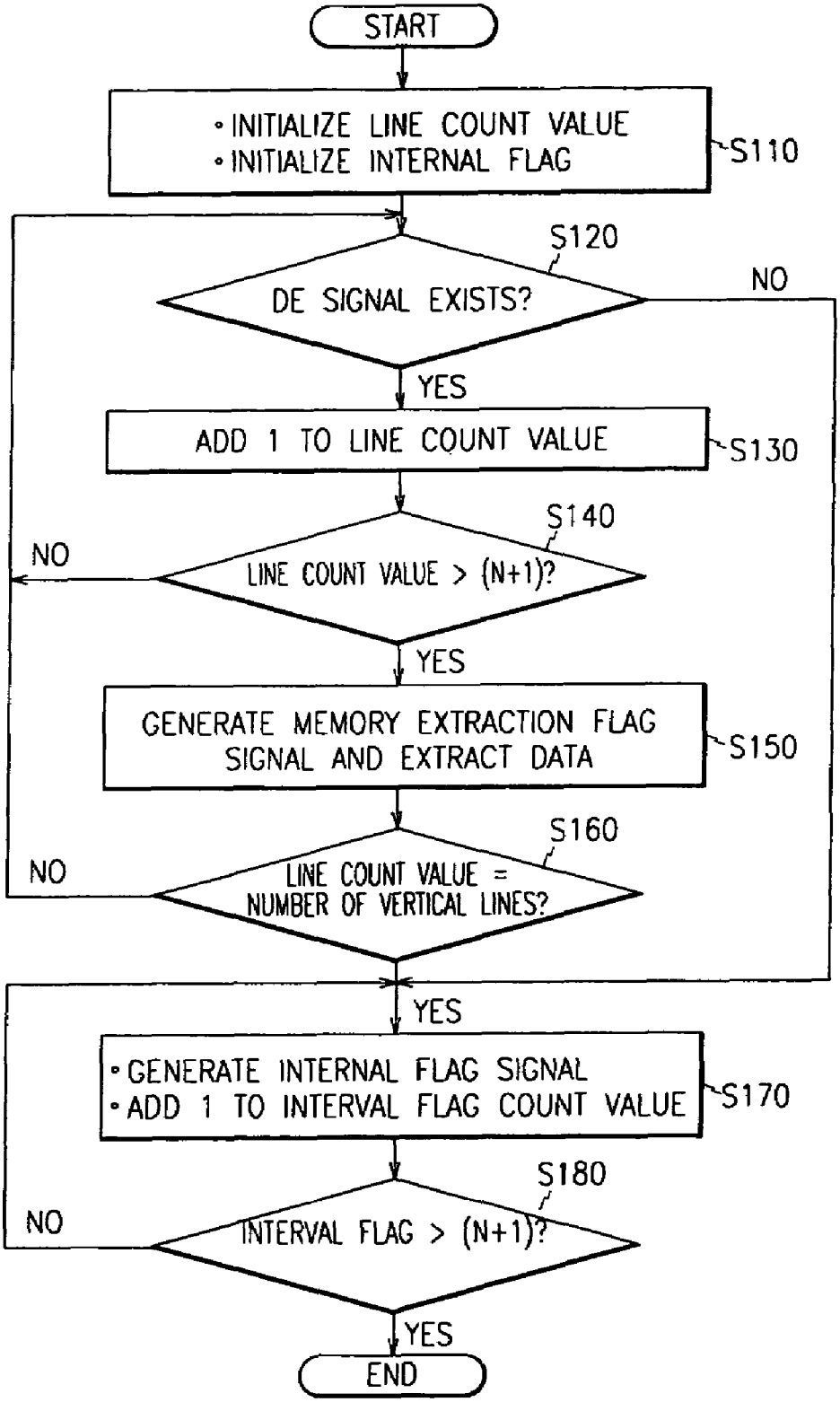
FIG. 6 is a flow chart illustrating generation of the vertical sync start signal when extracting data from a memory in accordance with an embodiment of the present invention.

FIG. 6 is a flow chart illustrating generation of the vertical sync start signal when extracting data from a line memory in accordance with an embodiment of the present invention.

Referring to FIG. 6, a line count value and an internal flag are first initialized at zero ('0'), in step s110. The internal flag is a signal used to form an extraction part of the memory in the interval destitute of a data-enable signal DE.

Subsequently, it is checked in step s120 whether the data-enable signal DE is present. If so, one ('1') is added to the line count value in step s130 and it is checked in step s140 whether the line count value is greater than the number of gate lines plus one, i.e., N+1. The number of gate lines represents an interval between the two vertical sync start signals STV.

If the line count value is not greater than N+1, the flow of the procedure returns to the routine of step s120. Otherwise, if the line value is greater than N+1, a memory extraction flag signal is generated to extract the data, in step s150.

It is then checked in step s160 whether the line count value is equal to the number of vertical lines. If not, the flow of the procedure returns to the routine of step s120.

If the line count value is equal to the number of vertical lines in step s160, or if there is no data-enable signal DE in step s120, the internal flag signal is generated and one ('1') is added to the internal flag count value, in step s170.

It is then checked in step s180 whether the internal flag count value is greater than the number of gate lines plus one, i.e., N+1. If not, the flow of the procedure goes to step s170; and otherwise, the flow ends.

Figure 7:
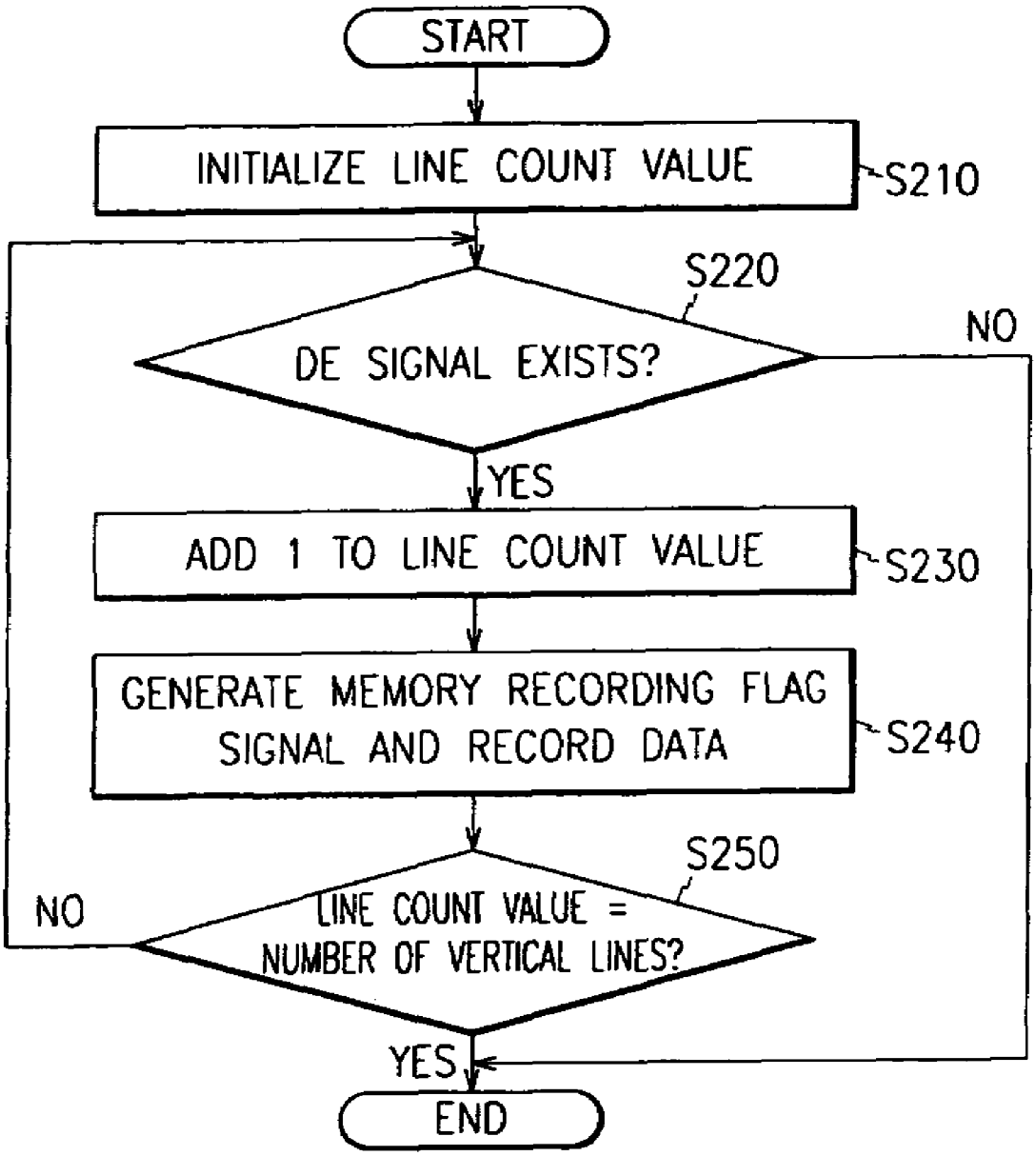
FIG. 7 is a flow chart illustrating generation of the vertical sync start signal when recording data in a memory in accordance with an embodiment of the present invention.

FIG. 7 is a flow chart illustrating generation of the vertical sync start signal when recording data on a line memory in accordance with an embodiment of the present invention.

Referring to FIG. 7, a line count value is first initialized at zero ('0'), in step s210. It is then checked in step s220 whether a data-enable signal DE is present. If so, one ('1') is added to the line count value, in step s230, and a memory recording flag signal is generated to record the data, in step s240.

Subsequently, it is checked in step s250 whether the line count value is equal to the number of vertical lines. If not, the flow of the procedure goes to step s220; and otherwise, the flow ends.

As described above, even through the data-enable signal to control the output of the RGB image data in the LCD using the pre-charging method is randomly applied, the internal data-enable signal is generated in synchronization with the rising of the data-enable signal input after two lines for the input data-enable signal, so that the generation interval of the LCD control signals can be changed to produce a normal display of an image.

The internal data-enable signals corresponding to the last two lines are automatically generated using a built-in counter to compensate for the missing internal data-enable signals of the two lines. Preferably, the blank interval of the internal data-enable signals automatically generated is constant at all times.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

As described above, the present invention uses a built-in counter based on input data-enable signals supplied from an external graphic controller so that an LCD control signal can be generated in spite of the irregular positions of the input data-enable signals. This allows a normal display of all data even though the data-enable signals are randomly input.

What is claimed is:

1. A method for driving an LCD that includes an LCD panel having a plurality of data lines and gate lines, which charges a specific pixel by (1) first charging the data of an pixel adjacent to the specific pixel and having the same polarity as the specific pixel to change the polarity of the corresponding pixel, and (2) second charging the data of the specific pixel, the method comprising:

(a) receiving image data from an external image signal source and a data-enable signal for controlling output of the image data;

(b) checking whether the data-enable signal has been received, sequentially recording the image data on a predetermined number of built-in memories upon receiving the data-enable signal, sequentially extracting the recorded image data, and generating an internal data-enable signal upon extraction of the image data to output a vertical sync start signal having a generation interval associated with a blank interval of the data-enable signal;

(c) applying a voltage corresponding to the image data to the data lines; and (d) sequentially applying both a first gate-on voltage and a second gate-on voltage based on the vertical sync start signal, wherein the first gate-on voltage drives a previous line being most adjacent to and having the same polarity as the present line, and the second gate-on voltage drives the present line.

2. The method as claimed in claim 1, wherein the built-in memories comprise a line memory.

3. The method as claimed in claim 1, wherein the vertical sync start signal comprises a signal for generating the first gate-on voltage and a signal for generating the second gate-on voltage.

4. The method as claimed in claim 1, wherein the predetermined number is at least one.

5. The method as claimed in claim 4, wherein the internal data-enable signal is generated in synchronization with the input data-enable signal shifted by a predetermined number of lines, the internal data-enable signal having the same polarity as the input data-enable signal.

6. The method as claimed in claim 1, wherein the output of the vertical sync start signal when sequentially extracting the data in step (b) comprises:

initializing a line count value and an internal flag;

checking whether the data-enable signal is present;

increasing the line count value by one and checking whether the updated line count value is greater than a first number of lines, which is the number of gate lines plus one, when the data-enable signal is present;

checking for a presence of the data-enable signal when the updated line count value is equal to or less than the first number of lines, and generating a memory extraction flag signal to extract the data when the updated line count value is greater than the first number of lines;

checking whether the updated line count value is equal to the number of gate lines, and if not, checking for a presence of the data-enable signal;

generating an internal flag signal and increasing an internal flag count value by one, when the updated line count value is equal to the number of gate lines or when the presence of data-enable signal is not detected; and comparing the updated interval flag count value with the first number of lines, ending the flow of the method when the internal flag count value is greater than the first number of lines, and repeating the generating of the internal flag signal and increasing of the internal flag count value by one when the internal flag count value is equal to or less than the first number of lines.

7. The method as claimed in claim 1, wherein the output of the vertical sync start signal when recording the data in step (b) comprises:

initializing a line count value;

checking whether the data-enable signal is present, ending the flow of the method when the data-enable signal does not exist, and increasing the line count value by one when the data-enable signal exists;

generating a memory-recording flag signal to record the data; and checking whether the updated line count value is equal to the number of vertically arranged gate lines, ending the flow of the method when the updated line count value is equal to the number of gate lines, and checking for a presence of the data-enable signal when the updated line count value is not equal to the number of gate lines.

8. A method for driving an LCD based on irregular-interval effective data, comprising:

providing one vertical sync start signal based on a data-enable signal having an irregular output interval to control output of the image data, the one vertical start signal having a generation interval associated with a blank interval of the data-enable signal based on the one vertical start signal, applying a first gate-on voltage and a second gate-on voltage to a same present gate line, wherein the first gate-on voltage drives a previous line being most adjacent to and having the same polarity as a present line, and the second gate-on voltage drives the present line;

charging an LCD panel with the first gate-on voltage, and then with the second gate-on voltage.

9. The method according to claim 8, wherein the LCD panel displays image data received during application of the second gate-on voltage.

10. A method for driving an LCD, the method comprising:

receiving image data and a first data-enable signal for controlling output of the image data;

generating a second data-enable signal and a vertical sync start signal based on the first data-enable signal, wherein the vertical sync start signal has a generation interval associated with a blank interval of the data-enable signal; and applying a first gate-on voltage and a second gate-on voltage to a gate line based on the vertical sync start signal, wherein the first gate-on voltage drives a previous line being most adjacent to and having the same polarity as the present line, and the second gate-on voltage drives the present line.

* * * * *